US009279206B2

(12) United States Patent
Ashrafzadeh et al.

(10) Patent No.: US 9,279,206 B2
(45) Date of Patent: Mar. 8, 2016

(54) METHOD AND APPARATUS FOR FORMING A COUNTERBALANCE TO AN IMBALANCE IN A LAUNDRY TREATING APPLIANCE

(75) Inventors: Farhad Ashrafzadeh, Stevensville, MI (US); Brian P. Janke, Saint Joseph, MI (US); Peter J. Richmond, Berrien Springs, MI (US); Marcelo Campos Silva, Joinville (BR); Rodrigo Stanziola Teixeira, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 1292 days.

(21) Appl. No.: 13/075,216

(22) Filed: Mar. 30, 2011

(65) Prior Publication Data

US 2012/0246835 A1 Oct. 4, 2012

(51) Int. Cl.
*D06F 37/20* (2006.01)

(52) U.S. Cl.
CPC ..... *D06F 37/203* (2013.01)

(58) Field of Classification Search
CPC ..... D06F 37/203
See application file for complete search history.

(56) References Cited

U.S. PATENT DOCUMENTS

| | | | | |
|---|---|---|---|---|
| 3,640,098 | A | 2/1972 | Eastall | |
| 4,344,198 | A | 8/1982 | Arendt et al. | |
| 5,325,677 | A | 7/1994 | Payne et al. | |
| 5,671,494 | A | 9/1997 | Civanelli et al. | |
| 5,692,313 | A | 12/1997 | Ikeda et al. | |
| 5,765,402 | A | 6/1998 | Ikeda et al. | |
| 6,240,586 | B1 * | 6/2001 | Joo | 8/159 |
| 7,296,445 | B2 | 11/2007 | Zhang et al. | |
| 7,530,133 | B2 | 5/2009 | Mitts | |
| 7,739,764 | B2 | 6/2010 | Zhang et al. | |
| 2008/0289118 | A1 | 11/2008 | Park et al. | |
| 2009/0307851 | A1 | 12/2009 | Bae et al. | |

FOREIGN PATENT DOCUMENTS

| | | | |
|---|---|---|---|
| DE | 3911124 | A1 | 10/1990 |
| DE | 19804080 | A1 | 8/1999 |
| EP | 0071308 | B1 | 5/1986 |
| EP | 0736625 | B1 | 11/1999 |
| EP | 0732437 | B1 | 7/2002 |
| FR | 2425494 | A1 | 12/1979 |
| GB | 2322141 | A | 8/1998 |
| GB | 2361715 | B | 10/2003 |
| WO | 2007134926 | A1 | 11/2007 |
| WO | 2010/072556 | A1 | 7/2010 |

OTHER PUBLICATIONS

German Search Report for corresponding DE102012100709, Sep. 21, 2012.

* cited by examiner

*Primary Examiner* — Jason Ko

(57) ABSTRACT

An apparatus and method for detecting an imbalance in the laundry load within the treating chamber and forming a counterbalance to the imbalance.

18 Claims, 6 Drawing Sheets

METHOD AND APPARATUS FOR FORMING A COUNTERBALANCE TO AN IMBALANCE IN A LAUNDRY TREATING APPLIANCE

BACKGROUND OF THE INVENTION

Laundry treating appliances, such as a washing machine in which a drum defines a treating chamber for receiving a laundry load, may implement cycles of operation. The cycles of operation may include different phases during which liquid is applied to the laundry load. The liquid may be removed from the laundry load during an extraction phase where the drum is rotated at speeds high enough to impart a centrifugal force on the load great enough to hold (a/k/a "plaster" or "satellize") the load to the peripheral wall of the drum (the clothes rotate with the drum and do not tumble) and extract liquid from the fabric items. During the acceleration to the extraction speed, the laundry may not distribute equally about the inner surface of the drum leading to an imbalance. If a sufficiently large enough load imbalance is present, the laundry treating appliance may experience undesirable vibrations and movements when the drum is rotated at spin speeds.

SUMMARY OF THE INVENTION

A method and apparatus for operating a laundry treating appliance when the presence of an imbalance has been determined. The method comprises forming a counterbalance to the imbalance, the counterbalance being formed with articles forming the laundry load.

DESCRIPTION OF AN EMBODIMENT OF THE INVENTION

Figure 1:
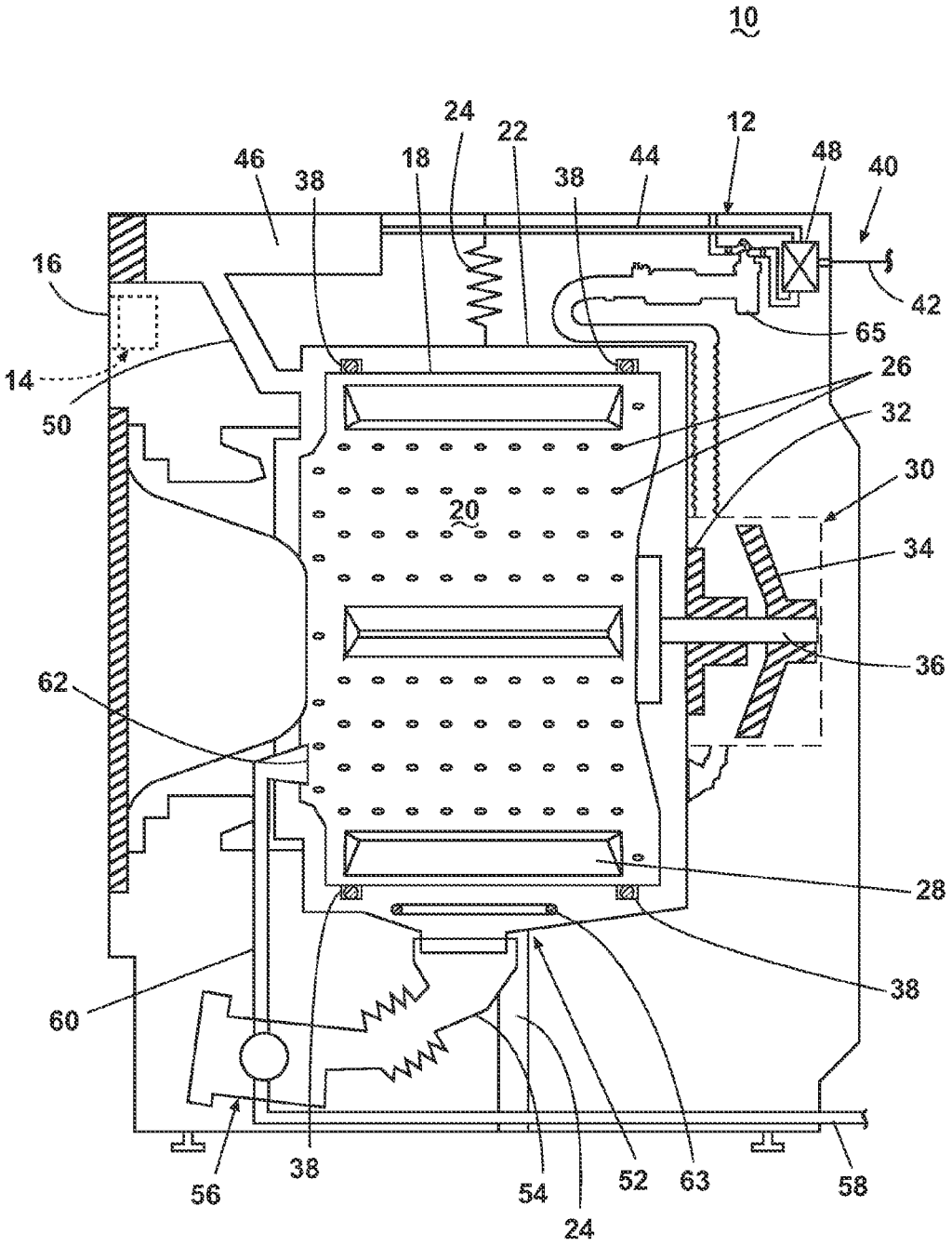
FIG. 1 is a sectional view of a laundry treating appliance according to one embodiment of the invention.

FIG. 1 illustrates one embodiment of the invention of a laundry treating appliance in the form of a washing machine 10. The laundry treating appliance may be any machine that treats articles such as clothing or fabrics. Non-limiting examples of the laundry treating appliance may include a horizontal or vertical axis washing machine; a horizontal or vertical axis dryer; a refreshing/revitalizing machine; an extractor; a non-aqueous washing apparatus; and a revitalizing machine. The washing machine 10 described herein shares many features of a traditional automatic washing machine, which will not be described in detail except as necessary for a complete understanding of the invention.

The washing machine 10 may include a cabinet 12, which may be a frame to which decorative panels are mounted. A controller 14 may be provided on the cabinet and controls the operation of the washing machine 10 to implement a cycle of operation. A user interface 16 may be included with the controller 14 to provide communication between the user and the controller 14. The user interface 16 may include one or more knobs, switches, displays, and the like for communicating with the user, such as to receive input and provide output.

A rotatable drum 18 may be disposed within the interior of the cabinet 12 and defines a treating chamber 20 for treating laundry. The rotatable drum 18 may be mounted within an imperforate tub 22, which is suspended within the cabinet 12 by a resilient suspension system 24. The drum 18 may include a plurality of perforations 26, such that liquid may flow between the tub 22 and the drum 18 through the perforations 26. The drum 18 may further include a plurality of lifters 28 disposed on an inner surface of the drum 18 to lift a laundry load 80 contained in the laundry treating chamber 20 while the drum 18 rotates.

While the illustrated washing machine 10 includes both the tub 22 and the drum 18, with the drum 18 defining the laundry treating chamber 20, it is within the scope of the invention for the washing machine 10 to include only one receptacle, with the receptacle defining the laundry treating chamber for receiving a laundry load to be treated.

A motor 30 is provided to rotate the drum 18. The motor 30 includes a stator 32 and a rotor 34, which is mounted to a drive shaft 36 extending from the drum 18 for selective rotation of the treating chamber 20 during a cycle of operation. It is also within the scope of the invention for the motor 30 to be coupled with the drive shaft 36 through a drive belt and/or a gearbox for selective rotation of the treating chamber 20.

The motor 30 may be any suitable type of motor for rotating the drum 18. In one example, the motor 30 may be a brushless permanent magnet (BPM) motor having a stator 32 and a rotor 34. Other motors, such as an induction motor or a permanent split capacitor (PSC) motor, may also be used. The motor 30 may rotate the drum 18 at various speeds in either rotational direction.

The washing machine 10 may also include at least one balance ring 38 containing a balancing material moveable within the balance ring 38 to counterbalance an imbalance that may be caused by laundry in the treating chamber 20 during rotation of the drum 18. The balancing material may be in the form of metal balls, fluid or a combination thereof. The balance ring 38 may extend circumferentially around a periphery of the drum 18 and may be located at any desired location along an axis of rotation of the drum 18. When multiple balance rings 38 are present, they may be equally spaced along the axis of rotation of the drum 18.

The washing machine 10 of FIG. 1 may further include a liquid supply and recirculation system 40. Liquid, such as water, may be supplied to the washing machine 10 from a water supply 42, such as a household water supply. A supply conduit 44 may fluidly couple the water supply 42 to the tub 22 and a treatment dispenser 46. The supply conduit 44 may be provided with an inlet valve 48 for controlling the flow of liquid from the water supply 42 through the supply conduit 44 to either the tub 22 or the treatment dispenser 46. The dispenser 46 may be a single-use dispenser, that stores and dispenses a single dose of treating chemistry and must be refilled for each cycle of operation, or a multiple-use dispenser, also referred to as a bulk dispenser, that stores and dispenses multiple doses of treating chemistry over multiple executions of a cycle of operation.

A liquid conduit 50 may fluidly couple the treatment dispenser 46 with the tub 22. The liquid conduit 50 may couple with the tub 22 at any suitable location on the tub 22 and is shown as being coupled to a front wall of the tub 22 in FIG. 1 for exemplary purposes. The liquid that flows from the treatment dispenser 46 through the liquid conduit 50 to the tub 22 typically enters a space between the tub 22 and the drum 18 and may flow by gravity to a sump 52 formed in part by a lower portion of the tub 22. The sump 52 may also be formed by a sump conduit 54 that may fluidly couple the lower portion of the tub 22 to a pump 56. The pump 56 may direct fluid to a drain conduit 58, which may drain the liquid from the washing machine 10, or to a recirculation conduit 60, which may terminate at a recirculation inlet 62. The recirculation inlet 62 may direct the liquid from the recirculation conduit 60 into the drum 18. The recirculation inlet 62 may introduce the liquid into the drum 18 in any suitable manner, such as by spraying, dripping, or providing a steady flow of the liquid.

Additionally, the liquid supply and recirculation system 40 may differ from the configuration shown in FIG. 1, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid. Further, the liquid supply and recirculation system 40 need not include the recirculation portion of the system or may include other types of recirculation systems.

A heating system, such as sump heater 63 and/or steam generator 65, may be provided for heating the liquid and/or the laundry.

Figure 2:
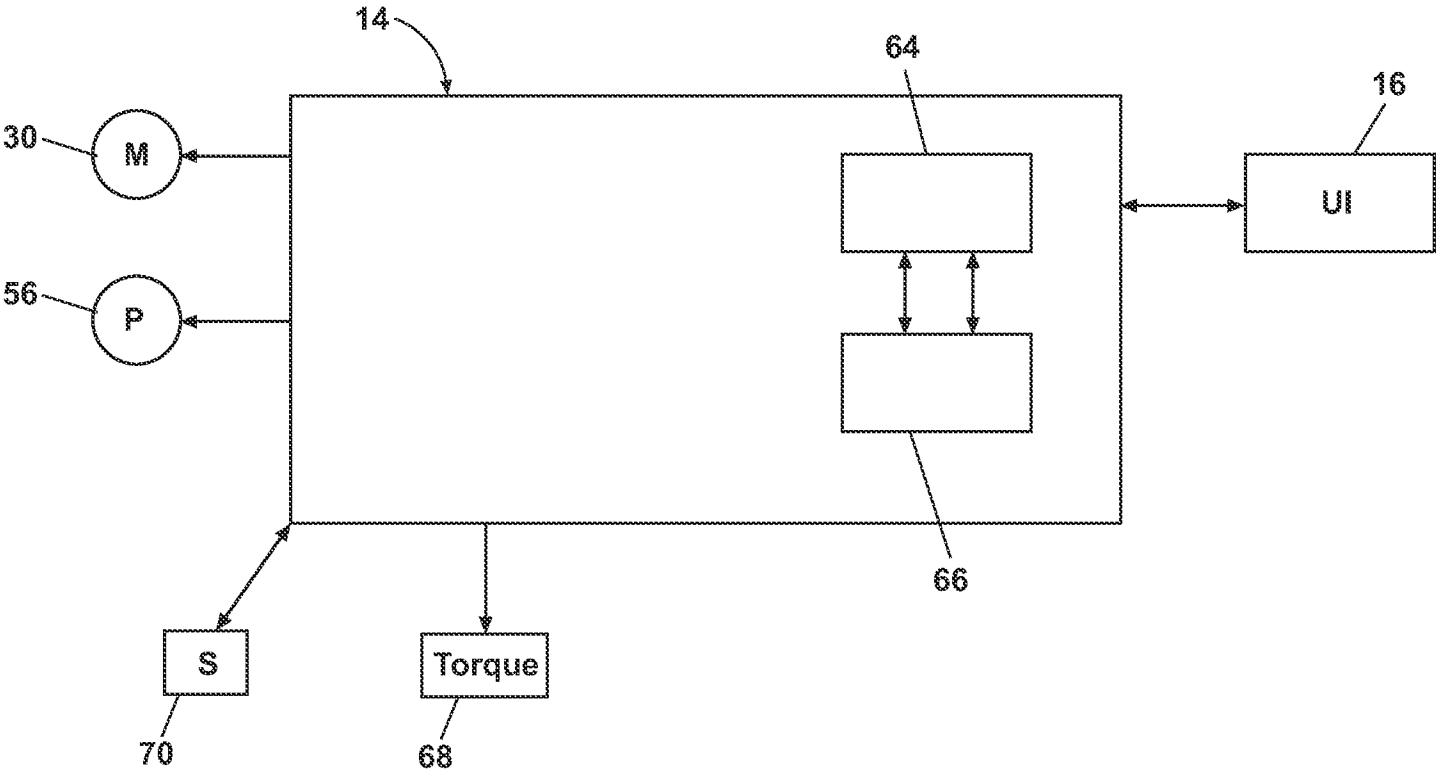
FIG. 2 is a schematic view of a controller of the laundry treating appliance of FIG. 1.
Figure 3:
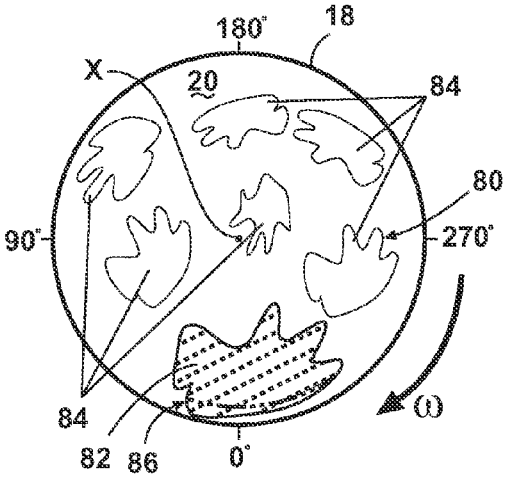
FIGS. 3-6 illustrate the formation of a counterbalance to an imbalance formed by a bulky or relatively immovable item during a spin phase of operation.

As illustrated in FIG. 2, the controller 14 may be provided with a memory 64 and a central processing unit (CPU) 66. The memory 64 may be used for storing the control software in the form executable instructions that is executed by the CPU 66 in executing one or more cycles of operation using the washing machine 10 and any additional software. The memory 64 may also be used to store information, such as a database or table, and to store data received from one or more components of the washing machine 10 that may be communicably coupled with the controller 14 as needed to execute the cycle of operation.

The controller 14 may be operably coupled with one or more components of the washing machine 10 for communicating with and controlling the operation of the component to complete a cycle of operation. For example, the controller 14 may be coupled with the user interface 16 for receiving user selected inputs and communicating information with the user, the motor 30 for controlling the direction and speed of rotation of the drum 18, and the pump 56 for draining and recirculating wash water in the sump 52. The controller 14 may also be operably coupled to the inlet valve 48, the steam generator 65, the sump heater 63, and the treatment dispenser 46 to control operation of the component for implementing the cycle of operation.

The controller 14 may also receive input from one or more sensors 70, which are known in the art. Non-limiting examples of sensors that may be communicably coupled with the controller 14 include: a treating chamber temperature sensor, a moisture sensor, a weight sensor, a drum position sensor, a motor torque sensor 68, and a motor speed sensor.

The dedicated motor torque sensor 68 may also include a motor controller or similar data output on the motor 30 that provides data communication with the motor 30 and outputs motor characteristic information, generally in the form of an analog or digital signal, to the controller 14 that is indicative of the applied torque. The controller 14 may use the motor characteristic information to determine the torque applied by the motor 30 using software that may be stored in the controller memory 64. Specifically, the torque sensor 68 may be any suitable sensor, such as a voltage or current sensor, for outputting a current or voltage signal indicative of the current or voltage supplied to the motor 30 to determine the torque applied by the motor 30. Additionally, the sensor may be a physical sensor or may be integrated with the motor and combined with the capability of the controller 14, may function as a sensor. For example, motor characteristics, such as speed, current, voltage, torque etc., may be processed such that the data provides information in the same manner as a separate physical sensor. In contemporary motors, the motors often have their own controller that outputs data for such information.

The washing machine 10 may further include means for detecting an imbalance 82 that has already formed, or is in the process of forming, in the laundry load 80 within the drum 18. The detecting means may further detect the rotational position and/or amount of the imbalance 82. The specifics of the detecting means are not germane to the invention, and will not be described in detail herein. There are many known imbalance detection methods that are based on output from a motor controller, load cell, or accelerometer. Often, such methods process the torque signal from the motor. Some examples of suitable methods for determining imbalance conditions in a clothes washing machine are given in U.S. Pat. No. 7,296,445 to Zhang et al. and U.S. Pat. No. 7,739,764 to Zhang et al. One known method for detecting the rotational position of an imbalance 82 uses the torque signal from the motor 30. As the drum 18 rotates, the motor torque required to rotate the drum 18 varies as a function of the rotational position of the load imbalance 82. In this manner, the position of the imbalance 82 may be determined as a function of the required motor torque.

The previously described washing machine 10 may be used to implement one or more embodiments of a method of the invention. The embodiments of the method function to determine the presence of an imbalance in the laundry load, and to form a counterbalance to the imbalance, the counterbalance being formed with articles that make up the laundry load.

Prior to describing a method of operation, a brief summary of the underlying physical phenomena is useful to aid in the overall understanding. The motor 30 may rotate the drum 18 at various speeds in either rotational direction. In particular, the motor 30 can rotate the drum 18 at speeds to effect various types of laundry load movement inside the drum 18. For example, the laundry load may undergo at least one of tumbling, rolling (also called balling), sliding, satellizing (also called plastering), and combinations thereof. During tumbling, the drum 18 is rotated at a tumbling speed such that the fabric items in the drum 18 rotate with the drum 18 from a lowest location of the drum 18 towards a highest location of the drum 18, but fall back to the lowest location before reaching the highest location. Typically, the centrifugal force applied by the drum to the fabric items at the tumbling speeds is less than about 1 G. During satellizing, the motor 30 may rotate the drum 18 at rotational speeds, i.e. a spin speed, wherein the fabric items are held against the inner surface of the drum 18 and rotate with the drum 18 without falling. This is known as the laundry being satellized or plastered against the drum 18. Typically, the force applied to the fabric items at the satellizing speeds is greater than or about equal to 1 G. For a horizontal axis washing machine 10, the drum 18 may rotate about an axis that is inclined relative to the horizontal, in which case the term "1 G" refers to the vertical component of the centrifugal force vector, and the total magnitude along the centrifugal force vector would therefore be greater than 1 G. The terms "tumbling", "rolling", "sliding" and "satellizing" are terms of art that may be used to describe the motion of some or all of the fabric items forming the laundry load. However, not all of the fabric items forming the laundry load need exhibit the motion for the laundry load to be described accordingly. Further, the rotation of the fabric items with the drum 18 may be facilitated by the lifters 28.

Centrifugal force (CF) is a function of a mass (m) of an object (a laundry item 84), an angular velocity (ω) of the object, and a distance, or radius (r) at which the object is located with respect to an axis of rotation (X), or a drum axis. Specifically, the equation for the centrifugal force (CF) acting on a laundry item within the drum 18 is:

$$CF=m*\omega^2*r$$

The centrifugal force (CF) acting on any single item in the laundry load can be modeled by the distance the center of gravity of that item is from the axis of rotation (X) of the drum 18. Thus, when the laundry items are stacked upon each other, which is often the case, those items having a center of gravity closer to the axis of rotation (X) experience a smaller magnitude centrifugal force (CF) that those items having a center of gravity farther away. It is possible to control the speed of rotation of the drum 18 such that the closer items will experience a centrifugal force (CF) less than 1 G, permitting them to tumble, while the farther away items still experience a centrifugal force (CF) equal to or greater than 1 G, retaining them in a fixed position relative to the drum 18.

Therefore, it is possible to control the speed of the drum 18 such that the items closer to the axis of rotation may tumble within the drum 18 while items farther from the axis of rotation and the immovable item remain fixed relative to the drum 18. This method may be used to form a counterbalance to the imbalance 82.

In some cases, the imbalance 82 may be a relatively immovable item that is substantially immovable relative to the drum 18 even during tumbling speeds. In this case, even when the drum 18 is rotated at a speed such that the immovable item experiences a centrifugal force (CF) less than 1 G, the immovable item remains plastered and does not tumble. Even in the case where the imbalance 82 does tumble somewhat, it will still create an imbalance as soon as it plasters against the drum 18 again because it cannot separate from itself and become balanced.

One example of an immovable item may be a bulky laundry item. Some non-limiting examples of bulky laundry items may include comforters, sleeping bags, jackets, down jackets, blankets, stuffed fabric articles (e.g., toys), work wear (e.g., heavy duty or stiff cloth work wear such as is worn in the construction industry), large towels, etc. For bulky items, their relative immovability and the resulting lack of tumbling is more a function of their physical shape, unlike non-bulky items, which require spin speeds and the resulting centrifugal force to plaster them to the drum 18. For bulky items, their physical shape also tends to interact with the drum structure, such as the drum wall and/or the lifters, to also render them relatively immovable. More specifically, bulky items have a higher likelihood to contact a side of the drum 18 than a smaller item does. The increased size of a bulky item increases its probability to have contact with the drum 18 and therefore increases its likelihood to plaster due to the radial distance from the axis of rotation. Therefore, a bulky item will have a high probability of having at least part of its mass on the outer portion of the drum 18, and its high density will tend to create an imbalance.

FIGS. 3-6 graphically illustrate a method where an imbalance 82 is created by at least a portion of a bulky item 86 is offset by a counterbalance 88 formed by other laundry items 84 in the laundry load 80. Beginning with FIG. 3, an unequally distributed laundry load 80, comprising a bulky laundry item 86 and multiple non-bulky laundry items 84, is shown in the treating chamber 20 defined by the drum 18 where the treating chamber 20 is rotated at a speed such that the laundry items 84 experience less than 1 G of centrifugal force and tumble, while the remaining bulky laundry item 86 forms an imbalance held against the inner surface of the drum 18 by its physical configuration alone and/or in combination with the acting centrifugal force.

Figure 4:
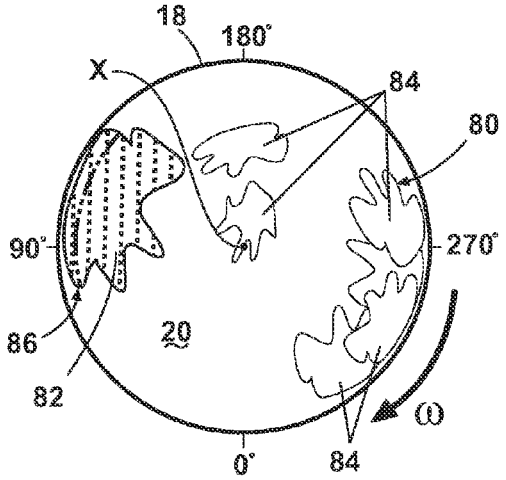
Figure 5:
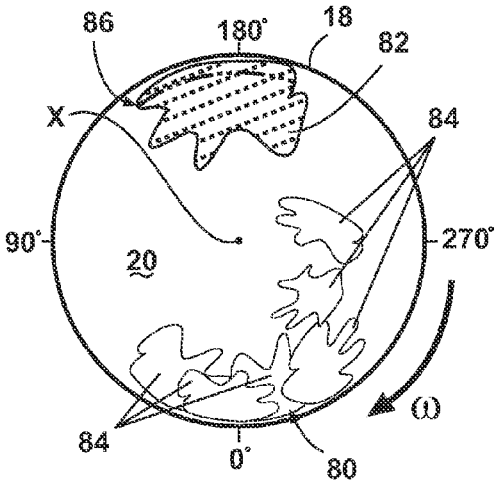
Figure 6:
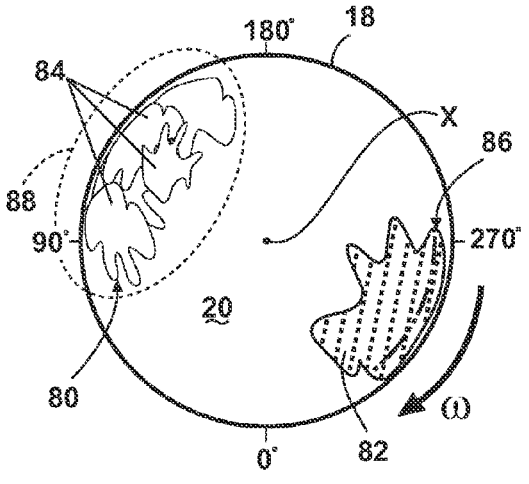

FIGS. 4 and 5 illustrate the progressive positions of the laundry load 80 in the treating chamber 20 during a counterbalance formation phase where the rotational speed of the treating chamber 20 is controlled to form the counterbalance 88 (see FIG. 6). During the counterbalance formation phase, the treating chamber 20 is accelerated from the rotational speed of FIG. 3 to a greater speed such that all of the laundry items 84 experience centrifugal force (CF) greater than or equal to 1 G and are satellized. To form the counterbalance 88, the rotational position of the imbalance 82 is taken into account when timing the initiating of the acceleration of the treating chamber 20. A rotational reference frame is provided in the drawings and ranges from 0° to 360° degrees, with the 0° being located at the lowermost point, which may be thought of as a 6 o'clock position when using a clock face as a reference.

For maximum benefit, it is best for the counterbalance 88 to be formed diametrically opposite the imbalance 82 or as close to diametrically opposite as is possible. Thus, the rotational speed of the drum 18 diametrically opposite the imbalance 82 should be great enough to plaster the laundry items 84 to the drum 18. The laundry items 84 also need to be in area diametrically opposite the imbalance 82 when the drum 18 reaches the spin speed for the laundry items 84 to be plastered and to form the counterbalance 88.

If the position of the laundry items 84 is known relative to the location of the imbalance 82, which may be accomplished using any number of known techniques, such as imaging techniques and analyzing the motor torque signal, the acceleration of the drum 18 can be timed such the drum 18 reaches the spin speed when the laundry items 84 are opposite the imbalance 82. Depending on many factors, such as current rotational speed, drum size, load size, and motor size, it may or may not be possible to effect an almost instantaneous acceleration to the spin speed, it may take multiple revolutions, or something in between. However, these factors will be known for a given system and the necessary timing can be programmed into controller 14.

Additionally, laundry items 84 may be incrementally added during the formation of the counterbalance 88. The size of the imbalance 82 can be monitored to determine if it has been appropriately counterbalanced. This cycle can be repeated until all the laundry items 84 have been plastered. In other words, the counterbalance 88 does not have to be created with all of the laundry items 84 in the drum 18; the counterbalance 88 can be incrementally added to until the imbalance 82 is properly balanced, after which the remainder of the laundry load 80 may then be evenly distributed.

In implementations where it is not possible to determine or sense the exact location of the laundry items 84 relative to the imbalance 82, the typical movement of the laundry items 84 relative to the bulky item 86 may be used to estimate the timing of the acceleration. For example, in the example of FIGS. 3-4 where the drum 18 is rotated clockwise at a tumbling speed, the laundry items 84 tend to be lifted to the area between 90° and 180°, where they then separate from the drum 18 and fall to the area between 270° and 0°, with the range of these areas varying a little depending on the speed of rotation while tumbling. The laundry items 84 also tend not to occupy the same space as the bulky item 86. Thus, when the bulky item 86 is entering the area between 90° and 180°, there is a strong likelihood that at least some of the laundry items 84 are present in the area between 270° and 0°. An opportunistic approach to forming the counterbalance 88 can be based on this motion by controlling the acceleration of the drum 18 such that as the imbalance 82 enters the area between 90° and 180°, the drum speed in the area between 270° and 0°, is great enough to plaster the laundry items 84 opposite the location of the imbalance 82 to form the counterbalance 88.

It goes without saying that if the drum 18 were rotated the opposite direction, counter-clockwise, the described laundry items 84 would tend to separate from the drum 18 between 270° and 180° and fall between 90° and 0°. Alternatively, one merely need reverse the direction of the rotational reference frame and the values would be the same. For purposes of this description, it may be assumed that the reference increases in the direction of rotation, thus only one set of values need be described.

The counterbalance 88 can be seen in the treating chamber, as circled in FIG. 6. FIG. 6 illustrates the position of the laundry load 80 where the imbalance 82 is counterbalanced by the counterbalance 88, and the rotational speed of the treating chamber 20 has been increased to a spin speed sufficient to satellize the entire laundry load 80. Once the counterbalance 88 has been formed it counters the imbalance 82. Ideally, the counterbalance 88 perfectly offsets the imbalance 82. However, as it is not possible to control the number of laundry items 84 a consumer places in the treating chamber 20, the size of the counterbalance 88 will depend on the laundry items 84. That said, any countering of the imbalance 82 is beneficial as it will enable greater spin speeds during an extraction step, which leads to greater water removal than that which could have been obtained without the counterbalance 88. Further, to prevent, over-counter balancing, monitoring of the effective off balance can be performed between drum 18 accelerations. Once the counterbalance 88 creates a zero effective imbalance within the drum 18, the remaining laundry items 84 that have not been plastered will be evenly distributed around the drum 18.

With this approach, it is only necessary to know the location of the imbalance 82 in order to properly form the counterbalance 88. While there are known methods for determining the rotational position of the imbalance 82, the invention proposes to determine the amount of the imbalance 82 by analyzing a signal indicative of the torque of the motor 30 in the frequency domain and to determine the position of the imbalance 82 by analyzing a signal indicative of the torque of the motor 30 in the time domain. Some examples of suitable methods for determining the rotational position of an imbalance in a clothes washing machine are given in U.S. Pat. No. 5,692,313 to Ikeda et al. and U.S. Pat. No. 5,765,402 to Ikeda et al.

Prior to determining the location of the imbalance 82, it may be useful to make an initial determination of the presence of the imbalance of an immovable item 86, which may be done by looking for an imbalance at either a tumbling speed or a spin speed. A method of determining an imbalance is fully described in commonly-owned patent application entitled, Method And Apparatus For Redistributing An Imbalance In A Laundry Treating Appliance, bearing docket number SUB-00846-US-NP, filed Dec. 10, 2010, and assigned U.S. application Ser. No. 12/964,763, which is incorporated by reference. The relevant portions are reproduced herein.

The analysis, and then monitoring, of the motor torque signal in the frequency domain provides valuable information regarding the size of the imbalance 82, especially as compared to analysis of the motor torque signal in the time domain. The analysis of the motor torque signal in the frequency domain may be done by the controller 14 processing the motor torque signal from the torque sensor 68 using a mathematical method, such as a Fast Fourier Transform (FFT) or a Sliding Discrete Fourier Transform (SDFT). Monitoring occurs by determining the position and amount of the imbalance 82 either continuously or at set intervals. Additionally, the position and amount value information may be stored in the memory 64. Alternatively, the position (not the amount) of the imbalance 82 may be determined, and then monitored, by analyzing a signal indicative of the torque of the motor 30 in the time domain, as is known in the art.

Figure 7:
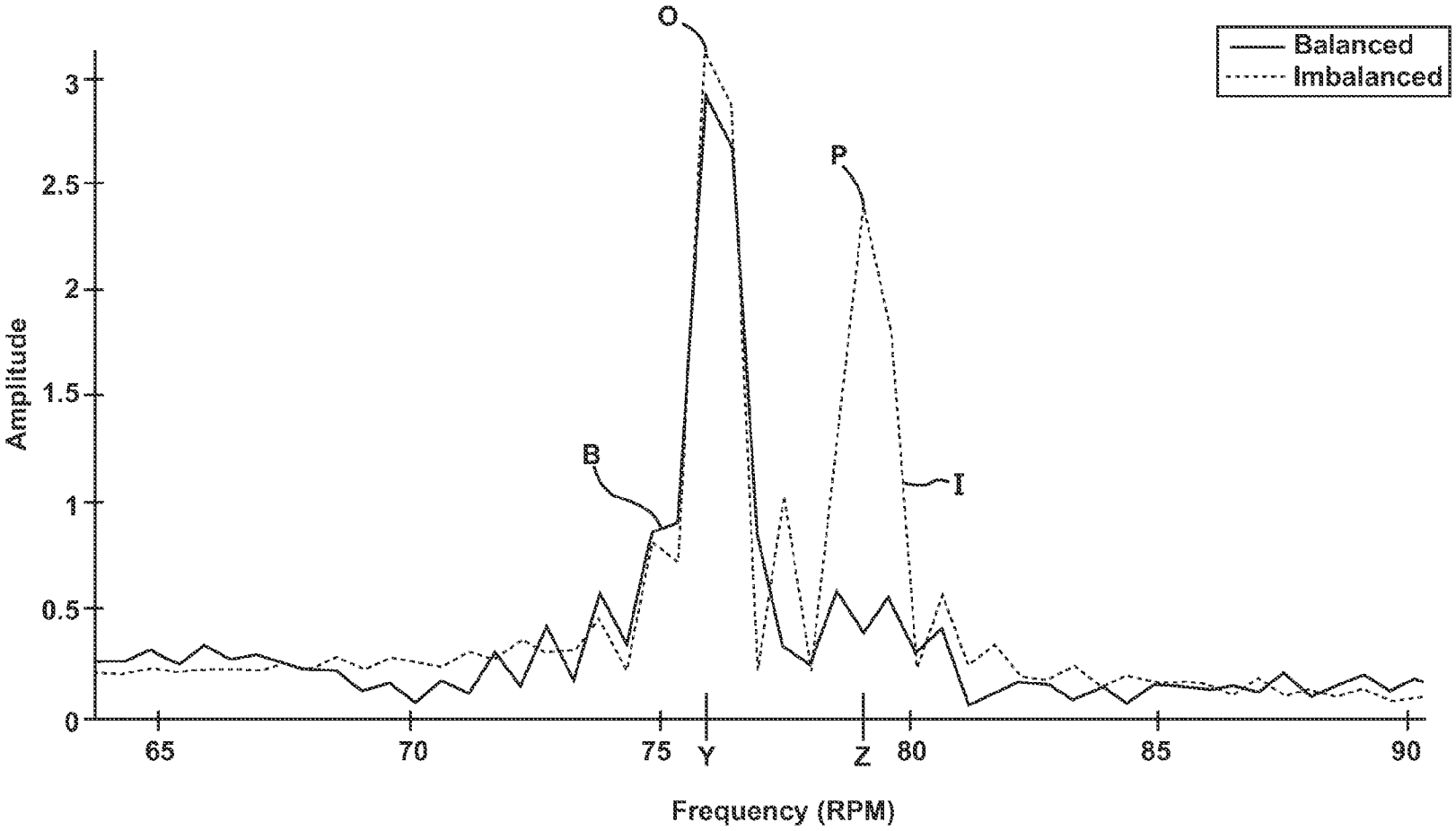
FIG. 7 is a graph of motor torque of a motor that drives the drum from the laundry treating appliance of FIG. 1, wherein the motor torque is shown in a frequency domain.

Referring now to FIG. 7, a graph of the motor torque signal shown in the frequency domain is illustrated. FIG. 7 is a snapshot of the frequency response of the motor torque signal when the drum 18 is rotated at a specific speed. The graph includes two sets of overlaid data: the amplitude of the frequency response for a balanced load (B), shown as a solid line, and an imbalanced load (I), shown as a dashed line. A significant peak (O) in both the balanced load (B) and the imbalanced load (I) can be seen at a frequency (Y), which is the frequency associated with the movement of the balancing material in the balancing ring(s) 38. This information is not useful, however, because both the balanced load (B) and the imbalanced load (I) peak at frequency (Y) with magnitudes that are not appreciably different for the given environment.

At a frequency (Z), which is approximately the rotational speed of the drum 18, a second and useful peak (P) can be seen. It has been found that the imbalanced load (I) has a large and readily apparent peak (P) at frequency (Z) that exists for the imbalanced load (I), but does not exist for the balanced load (B). This second peak (P) at frequency (Z) is directly attributed to the imbalance of the laundry load 80. Thus, an imbalance 82 may be detected by the controller 14 through analysis of the motor torque signal in the frequency domain. More specifically, the motor torque signal can be viewed in the frequency domain to determine if the peak (P) exists at a frequency approximately that of the rotational speed of the drum 18. If the peak (P) does exist, the controller 14 may determine that an imbalance 82 is present. This method can be used to accurately determine the existence of an imbalance 82 in a washing machine 10 with or without ball balancers.

The data shows that even the balanced load (B) has some minor peaks as compared to the peak (P) of the imbalanced load. Thus, a practical implementation of a control based on this approach may use a threshold peak value, which may be determined experimentally, to determine when the magnitude of the peak is sufficient to be indicative of an imbalance 82, such as peak (P). When the magnitude of the peak (P) satisfies the threshold value, such as being above the threshold value, the imbalance 82 may be determined to be present. The threshold value for the magnitude of the peak (P) may be selected in light of the characteristics of a given machine. For example, such a threshold may be a function of the imbalance 82 that the suspension system 24 can accommodate. Further, the counterbalance 88 may be formed to an amount that is within a predetermined measure of the amount of the imbalance 82. As a non-limiting example, it may be desirable to form a counterbalance 88 that is approximately 50% of the mass of the imbalance 82. In addition, this method can be used to verify a successful redistribution. In other words, after the corrective action has been completed, the frequency domain signal can be checked to confirm an imbalance improvement and/or an imbalance within an acceptable threshold.

Figure 8:
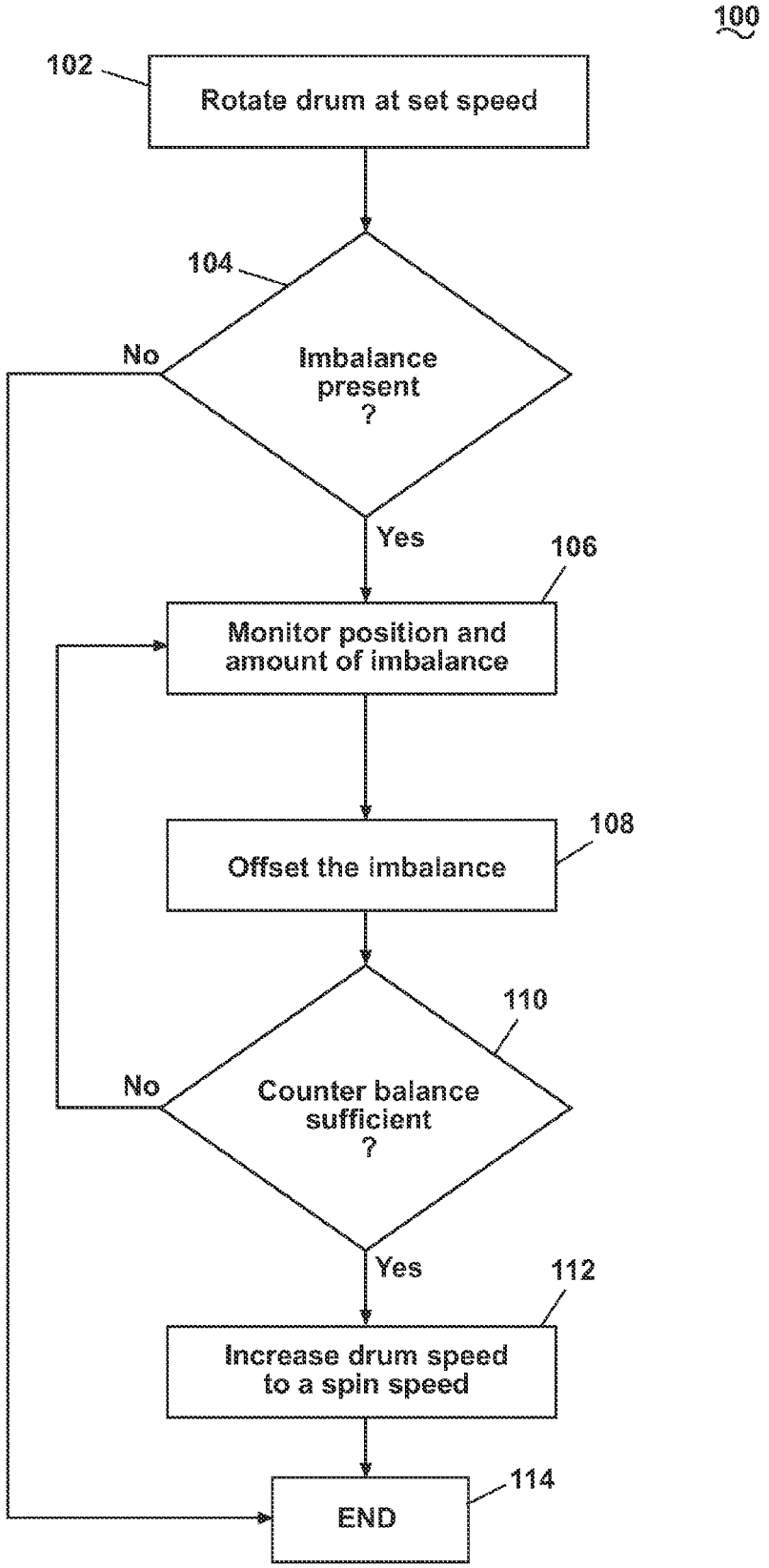
FIG. 8 is a flow chart illustrating a counterbalance formation method according to an embodiment of the invention.

FIG. 8 illustrates a flow chart corresponding to a method of operating the washing machine 10 using a counterbalance formation method based on the above described phenomena as implemented during the cycle of operation according to one embodiment of the invention. The counterbalance formation method 100 may be implemented in any suitable manner, such as automatically or manually, as a stand-alone phase or cycle of operation or as a phase of an operation cycle of the washing machine 10. The cycle of operation may include other individual cycles or phases, such as a wash phase and/or a rinse phase, or the cycle of operation may have only the counterbalance formation method 100. When the cycle of operation includes other individual phases, the counterbalance formation method 100 may function as an intermediate counterbalance formation phase, a final counterbalance formation phase, or other type of counterbalance formation phase. Regardless of the implementation of the counterbalance formation method 100, the counterbalance formation method 100 may be employed to form a counterbalance 88 to the imbalance 82 utilizing a subset of the multiple laundry items 84 in the treating chamber 20 that make up the laundry load 80.

The counterbalance formation method 100 begins with rotation of the drum 18 at a first set speed at 102, which is a rotational speed less than satellization speed.

At 104, while the drum 18 is rotating at the set speed, the presence of an imbalance 82 which may or may not be caused by an immovable item 86, may be determined by the controller 14. In determining the presence of an imbalance 82, it may be desirable to determine the presence of an imbalance 82 greater than a predetermined threshold as some imbalance is permissible under normal operating conditions. The term "satisfies" the threshold is used here to mean the value compared to the threshold or reference value meets the desired criteria of the comparison because the criteria and threshold values may easily be altered to be satisfied by a positive/negative comparison or a true/false comparison.

The determination of the presence of an imbalance 82 may be made in several ways, including those previously described. It may be determined using accelerometers or load sensors, which may be one of the sensors 70. It may also be determined by the time domain torque signal, which is still useful for determining the presence of an imbalance 82, but not as useful for determining the amount of the imbalance 82. Another example of which is by analyzing a motor characteristic signal indicative of the motor torque in the frequency domain as described above.

If an imbalance 82 is determined to be present, the controller 14 may determine and monitor the position of the imbalance 82, as at 106. As explained above, the position of the imbalance 82 may be determined, and then monitored, by analyzing a signal indicative of the torque of the motor 30 in the frequency domain.

At 108, the controller 14 may effect the formation of a counterbalance formation, as described above, to offset the imbalance 82.When the monitoring at 106 indicates that the imbalance 82 is in the desired position to form the counterbalance 88, the drum 18 may be accelerated as previously described. Laundry items 84 may be incrementally added to the counterbalance 88 during the formation of the counterbalance 88. The formation of the counterbalance 88 need not occur in just one drum 18 acceleration.

At 110, the controller 14 may determine if the counterbalance 88 is sufficient by monitoring the amount of the imbalance 82 using any of the previously described methods. The counterbalance 88 may be determined to be sufficient when the amount, for example the weight, of the counterbalance 88 satisfies the predetermined measure of the amount of imbalance 82, as described above. Additionally, 106-110 may be repeated as needed until a sufficient counterbalance 88 is formed.

Once the counterbalance 88 has been sufficiently formed to counterbalance the imbalance 82 and a permissible imbalance is realized within the treating chamber 20, the rotational speed of the drum 18 may be increased to a spin speed, such as an extraction speed, as at 112. Optionally, the rotational speed at 112 may be a function of the difference in the weight of the imbalance 82 and the weight of the counterbalance 88. For example, the smaller the difference between the weight of the imbalance 82 and the counterbalance 88, the greater the speed at which the drum 18 may be rotated.

The counterbalance formation method 100 ends at 114, and control passes back to the controller 14 to implement the rest, if any, of the cycle of operation.

If, at any time thereafter, a non-suitable imbalance arises within the treating chamber 20, the rotational speed of the drum 18 may be reduced, and control may pass back to 104 to implement a new counterbalance formation phase and the counterbalance formation method 100 is repeated. This process is repeated until the imbalance 82 is sufficiently counterbalanced or the cycle of operation is completed.

Figure 9:
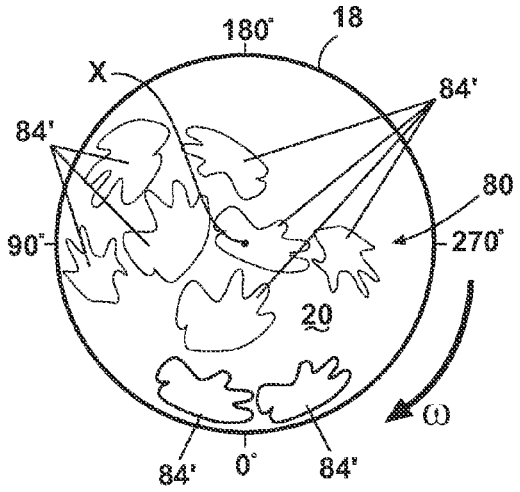
FIGS. 9-11 illustrate the formation of a counterbalance to an imbalance formed by multiple articles during a spin phase of operation.
Figure 10:
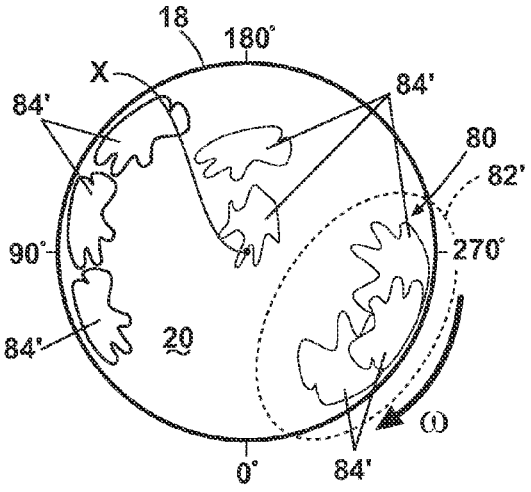
Figure 11:
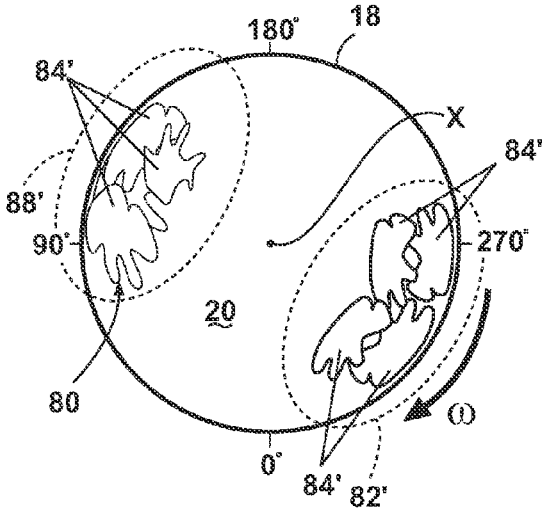

FIGS. 9-11 illustrate the formation of the counterbalance where the imbalance is formed by multiple fabric items. In this method, an imbalance 82' is created by multiple movable laundry items 84' and is offset by a counterbalance 88' formed by the other movable laundry items 84' in the laundry load. Beginning with FIG. 9, while the drum 18 is being rotated at a tumbling speed, the movable laundry items 84 initially tumble within the treating chamber 20. As FIG. 10 illustrates, at some point, for a variety of well-known reasons, such as some of the movable laundry items 84' balling or otherwise becoming entangled, or some moveable items 84' satellizing and then holding other movable items 84', an imbalance 82', comprising multiple laundry items 84', forms on the inner surface of the drum 20. The presence and location of the imbalance 82' may be determined as previously described.

Using the method of FIG. 8, a counterbalance 88' to the imbalance 82' can be formed by selectively controlling the rotational speed of the drum to satellize one or more of the remaining movable laundry items 84' into a counterbalancing-mass on the opposite side of the drum 20. The initial stages of the formation of the counterbalance 88' are shown in FIG. 10, with the completion of the counterbalance 88' being shown in FIG. 11. For convenience, FIG. 11 is shown with all of the movable items 84' forming the counterbalance 88'. However, in reality, there may well be many other moveable laundry items 84' within the drum 18, which do not form part of the counterbalance 88'. The other laundry items 84' may continue to tumble and/or be satellized depending on the rotational speed of the drum 18.

Once a sufficient counterbalance 88' is formed, the rotational speed of the drum 18 may then be increased without concern for the effects attributable to the imbalance 82'. For example, if a liquid extraction phase is desired, the drum 18 may be accelerated to the extraction speeds, which are often many times greater than the spin speed.

A sufficient counterbalance 88' need not perfectly offset the imbalance 82'. In many cases, it is sufficient if the counterbalance 88' offset the imbalance 82' such that any remaining imbalance is within the acceptable limits of the suspension system. In some cases, there may be insufficient movable laundry items 84' to completely offset the imbalance. Regardless of whether the remaining imbalance is within the acceptable limits of the suspension system, some amount of counterbalance is better than none because many operational parameters may be set as a function of the magnitude of the sensed imbalance.

A benefit of the counterbalance formation method 100 lies in the ability to continue the cycle of operation even though an imbalance 82 is present in the laundry load. In some prior methods, the drum 18 would have to be stopped, and the washing machine 10 would require user intervention before carrying out the remainder of the cycle of operation. Another benefit of the method of the invention lies in not ceasing the rotation of the drum 18 to address the imbalance 82. Controlling the rotational speed of the drum 18 rather than stopping the drum 18, as in some prior methods, to counterbalance an imbalance 82 in the laundry load 80 saves energy because the motor 30 does not need to be restarted from zero rotational speed. Additionally, with the counterbalance formation method 100, as soon as the counterbalance has been formed and a net zero off balance is determined, the cycle of operation may immediately continue. In summary, with the method of the invention, the imbalance may be countered and the drum is not stopped, which leads to improved energy consumption and shorter cycle times.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for operating a laundry treating appliance having a rotating treating chamber for receiving a laundry load formed of multiple articles for treatment, a motor rotating the treating chamber, and a controller operably coupled to the motor to control the rotation of the treating chamber according to a cycle of operation, the method comprising:

a) rotating the treating chamber, with a laundry load therein, at a first rotational speed;

b) determining a presence of an imbalance in the laundry load; and c) forming a counterbalance to the determined imbalance with a subset of the multiple articles forming the laundry load by controlling a rotational speed of the treating chamber to satellize the subset of the multiple articles into a counterbalancing mass substantially diametrically opposite to the present imbalance.

2. The method of claim 1 wherein the forming the counterbalance is accomplished without stopping or reversing the rotation of the treating chamber.

3. The method of claim 1 wherein substantially diametrically opposite comprises an area between 270 and 90 degrees, where 0 degrees is defined by a vertically lowest point of the treating chamber and 180 degrees is defined by a vertically highest point of the treating chamber for a revolution of the treating chamber.

4. The method of claim 1 wherein an amount of the counterbalance is within a predetermined measure of an amount of present imbalance.

5. The method of claim 1 wherein the forming the counterbalance comprises accelerating the rotational speed of the treating chamber to a satellizing speed sufficient to satellize at least some of any tumbling laundry items when a center of gravity of the present imbalance is located between 90 and 270 degrees, where 0 degrees is defined by a vertically lowest point of the treating chamber and 180 degrees is defined by a vertically highest point of the treating chamber for a revolution of the treating chamber.

6. The method of claim 5 wherein the accelerating the treating chamber to the satellizing speed occurs when the center of gravity of the present imbalance is located between 90 and 200 degrees.

7. The method of claim 1 wherein the present imbalance is formed by at least one laundry item that is substantially immovable relative to the treating chamber during tumbling rotational speeds.

8. The method of claim 7 wherein the counterbalance is formed by at least one laundry item that is substantially movable relative to the treating chamber during tumbling rotational speeds.

9. The method of claim 1 wherein the determining the imbalance comprises monitoring a signal of the motor torque in the frequency domain.

10. The method of claim 9 wherein monitoring the signal in the frequency domain comprises monitoring a frequency representative of the rotational speed of the treating chamber.

11. The method of claim 10 wherein a magnitude of the monitored frequency exceeding a predetermined threshold is indicative of the presence of the imbalance.

12. The method of claim 1, further comprising increasing the rotational speed of the treating chamber to a second rotational speed sufficient to satellize all articles forming the laundry load to the treating chamber.

13. The method of claim 12 wherein the second rotational speed is a function of a difference in an amount of the present imbalance and an amount of the counterbalance.

14. The method of claim 13 wherein the second rotational speed is an extraction speed.

15. The method of claim 14 wherein the second rotational speed is greater than the first rotational speed.

16. The method of claim 15 wherein the first rotational speed is a spin speed, which is a rotational speed sufficient to apply at least a 1 g centrifugal force to laundry in the treating chamber.

17. The method of claim 1 wherein controlling the rotational speed of the treating chamber to satellize the subset of the multiple articles into a counterbalancing mass comprises timing initiation of acceleration of the treating chamber based on a rotational position of the determined imbalance.

18. The method of claim 1 wherein laundry articles are incrementally added to the counterbalancing mass.

* * * * *